US008511387B2

(12) United States Patent
Fraser et al.

(10) Patent No.: US 8,511,387 B2
(45) Date of Patent: Aug. 20, 2013

(54) MADE-UP FLANGE LOCKING CAP

(75) Inventors: Thomas A Fraser, Spring, TX (US); John G Landthrip, Katy, TX (US); Eric D Larson, Tomball, TX (US); Sara N Riddle, Houston, TX (US); Dale Norman, Spring, TX (US); Jamie C Gamble, Houston, TX (US); Satish N Ramasheshaiah, Houston, TX (US); James R Reams, Houston, TX (US)

(73) Assignee: BP Corporation North America Inc., Houston, TX (US)

( * ) Notice: Subject to any disclaimer, the term of this patent is extended or adjusted under 35 U.S.C. 154(b) by 246 days.

(21) Appl. No.: 12/975,080

(22) Filed: Dec. 21, 2010

(65) Prior Publication Data

US 2012/0006557 A1 Jan. 12, 2012

Related U.S. Application Data

(60) Provisional application No. 61/362,960, filed on Jul. 9, 2010.

(51) Int. Cl.
*E21B 41/04* (2006.01)
*E21B 19/00* (2006.01)

(52) U.S. Cl.
USPC ..... 166/350; 166/338; 166/339; 166/341; 166/342; 166/85.4

(58) Field of Classification Search
USPC ..... 166/338, 339, 341, 342, 363, 364, 166/85.4; 285/29, 351
See application file for complete search history.

(56) References Cited

U.S. PATENT DOCUMENTS

| | | | | | |
|---|---|---|---|---|---|
| 2,962,096 | A | * | 11/1960 | Knox | 285/27 |
| 3,325,190 | A | | 6/1967 | Eckert et al. | |
| 3,693,714 | A | * | 9/1972 | Baugh | 166/348 |
| 3,820,600 | A | * | 6/1974 | Baugh | 166/338 |
| 3,841,665 | A | * | 10/1974 | Capot | 285/2 |

(Continued)

FOREIGN PATENT DOCUMENTS

| | | |
|---|---|---|
| GB | 1374712 | 11/1974 |
| GB | 2443776 | 5/2008 |
| WO | 9823845 A1 | 6/1998 |
| WO | 03048512 A1 | 6/2003 |

OTHER PUBLICATIONS

U.S. Appl. No. 13/038,044, filed Mar. 1, 2011.
U.S. Appl. No. 12/975,100, filed Dec. 21, 2010.

(Continued)

*Primary Examiner* — Matthew Buck
*Assistant Examiner* — James Sayre
(74) *Attorney, Agent, or Firm* — Jayne C. Piana

(57) ABSTRACT

A cap is lowered onto and secured to a subsea member with an external flange, effecting a seal between the external flange and cap. The cap includes a tubular outer body defining a cavity, and a tubular inner body defining a bore, wherein the lower end of the inner body resides within the cavity. The cap also includes a lower engaging member coupled to the outer body that is radially movable between an inward state and an outward state and configured to alternately engage and disengage at least one of a backside of the external flange. Finally, the cap includes an upper engaging member coupled to the outer body and being radially movable independently of the lower engaging member between an inward state and an outward state and configured to engage and disengage the inner body.

20 Claims, 8 Drawing Sheets

(56) References Cited

U.S. PATENT DOCUMENTS

| | | | | |
|---|---|---|---|---|
| 4,057,267 | A | 11/1977 | Jansen, Jr. | |
| 4,427,072 | A | 1/1984 | Lawson | |
| 4,433,859 | A | 2/1984 | Driver et al. | |
| 4,526,406 | A | 7/1985 | Nelson | |
| 4,595,053 | A | 6/1986 | Watkins et al. | |
| 4,856,594 | A * | 8/1989 | Jennings | 166/338 |
| 4,902,044 | A | 2/1990 | Williams et al. | |
| 5,433,274 | A | 7/1995 | Graff et al. | |
| 6,035,938 | A | 3/2000 | Watkins | |
| 6,129,149 | A | 10/2000 | Beall | |
| 6,328,343 | B1 | 12/2001 | Hosie et al. | |
| 6,330,918 | B1 | 12/2001 | Hosie et al. | |
| 6,510,897 | B2 | 1/2003 | Hemphill | |
| 6,698,800 | B2 | 3/2004 | Spiering et al. | |
| 7,337,848 | B2 | 3/2008 | Fraser et al. | |
| 2003/0168857 | A1 | 9/2003 | Jennings | |
| 2009/0308658 | A1 | 12/2009 | Larson et al. | |
| 2010/0024907 | A1 * | 2/2010 | Tibbitts | 137/614.04 |
| 2012/0000664 | A1 * | 1/2012 | Nas et al. | 166/344 |

OTHER PUBLICATIONS

Search Report from corresponding GB Application No. GB1111506.0 dated Sep. 2, 2011.

Search Report from corresponding GB Application No. GB1111504.5 dated Sep. 26, 2011.

Office Action mailed on Jul. 20, 2012, in U.S. Appl. No. 12/975,100, 26 pages.

* cited by examiner

MADE-UP FLANGE LOCKING CAP

This application claims the benefit of U.S. Provisional Application No. 61/362,960, filed on Jul. 9, 2010, entitled "Made-Up Flange Locking Cap," which application is hereby incorporated herein by reference.

FIELD OF THE INVENTION

This invention relates in general to a cap for deploying subsea to connect to a flange connection that has been previously made up and has a severed upper end.

BACKGROUND OF THE INVENTION

In subsea drilling operations, drilling operators generally deploy remotely operated vehicles (ROVs) to the wellhead in emergency situations to enable devices designed to cap, cut off, or contain the flow of hydrocarbons from a well. In some instances, a remotely operated vehicle will activate a blowout preventer (BOP) designed to shut off the flow of hydrocarbons from the wellhead. Activating a BOP will engage rams within the BOP that pinch shut or otherwise disable the wellhead in a manner that significantly limits the ability of the operators to continue use of the wellhead. Therefore, there is a need for an apparatus to cap, cut off, or contain the flow of hydrocarbons from a wellhead without limiting the ability of the operators to continue to use the wellhead.

A second way drilling operators attempt to contain flow of hydrocarbons from a wellhead in emergency situations involves a containment dome or "Top Hat". Use of a containment dome involves lowering a large device over the wellhead to contain flowing hydrocarbons. Oil workers attach riser pipes to the containment dome to remove the hydrocarbons collected within the containment dome. In this manner, the containment dome captures hydrocarbons from a wellhead for transportation to surface vessels. However, use at the depths of some deepwater drilling sites causes methane hydrate crystals to form within the containment dome. These methane hydrate crystals block the openings that oil workers use to remove hydrocarbons from the containment dome. Therefore, there is a need to for an apparatus to aid in the capture of hydrocarbons from a wellhead located at great depth without using a containment dome.

Oil operators sometimes engage a method called "top kill" to cap or cut off the flow of hydrocarbons from a wellhead in emergency situations. In this procedure, oil workers connect drilling pipe to the BOP through a manifold. Oil workers then pump drilling mud into the well in sufficient quantities to slow and then stop the passage of hydrocarbons from the wellhead. Once the drilling mud reaches sufficient quantities to overcome the reservoir pressure at the wellhead, hydrocarbon flow stops, and oil workers use cement to seal the well. In instances where drilling mud alone is insufficient to stop hydrocarbon flow, oil workers will utilize a "junk shot". A junk shot involves pumping materials of a more solid nature along with more drilling mud into the wellhead in an effort to block or plug the flow of hydrocarbons. Much like use of a BOP, top kill and junk shots effectively stop any further use of the wellhead for the production of hydrocarbons. Therefore, there is a need for an apparatus that can stop hydrocarbon flow from a wellhead without limiting further use of the well.

Another method operators use to contain the flow of hydrocarbons from a wellhead in emergency situations involves cutting off the end of a lower riser and capping the wellhead with a modified Lower Marine Riser Package (LMRP). This method, similar to the containment dome, attempts to direct the flow of hydrocarbons into a subsea containment vessel from which oil workers pump the hydrocarbons for further action. Unlike the containment dome, LMRP does not attempt to collect and contain all the hydrocarbons from the wellhead. Thus, even where used, all hydrocarbon flow is not stopped or contained. LMRP also makes complete capping of the well more difficult by shearing off the riser line. Shearing off the riser line removes any blockages from the hydrocarbon path that slowed the rate of hydrocarbon flow, thus making it more difficult to eventually cap or contain the well completely. At times, shearing off the end of a lower rise is necessary to perform other operations at the wellhead. Thus, there is a need for an apparatus that can cap, cut off, or contain the flow of hydrocarbons where a riser has been sheared off for other purposes.

SUMMARY OF THE INVENTION

These and other problems are generally solved or circumvented, and technical advantages are generally achieved, by preferred embodiments of the present invention that provide a made-up flange locking cap, and a method for using the same.

In accordance with an embodiment of the present invention, an apparatus for connecting to a subsea member having an external flange or a connection point comprises a tubular outer body defining a cavity, and a tubular inner body defining a bore, wherein the lower end of the inner body resides within the cavity. The apparatus also comprises a lower engaging member coupled to the outer body, the lower engaging member being radially movable between an inward state and an outward state and configured to alternately engage and disengage at least one of a backside of the external flange and a connection point. Finally, the apparatus has an upper engaging member coupled to the outer body and being radially movable independently of the lower engaging member between an inward state and an outward state and configured to engage and disengage the inner body, and at least one of the upper engaging member and the inner body having a ramp surface to exert a preload force on a seal disposed between the apparatus and the subsea member as the upper engaging member is moved inwardly toward the inward state.

In accordance with an another embodiment of the present invention, an apparatus for capping a subsea member having an external flange comprises a tubular outer body defining a cavity, and a tubular inner body defining a bore, the inner body having an inner body flange at a lower end of an exterior of the inner body, wherein the lower end of the inner body resides within the cavity. The apparatus also comprises a plurality of lower dogs coupled to the outer body, the plurality of lower dogs being radially movable between an inward state and an outward state and configured to alternately engage and disengage a lower side of the external flange. The apparatus also has a plurality of upper dogs coupled to the outer body and being radially movable independently of the plurality of lower dogs between an inward state and an outward state and configured to engage and disengage an upper side of the inner body flange, and at least one of the plurality of upper dogs having a ramp surface on the lower side of the upper dogs to engage one of the sides of the inner body flange to exert a preload force between the apparatus and the subsea member.

In accordance with yet another embodiment of the present invention, a method for connecting to a subsea member having an external flange or a connection point comprises the steps of providing a locking cap with a tubular outer body defining a cavity. The locking cap also comprising a tubular inner body defining a bore, wherein the lower end of the inner body resides within the cavity. The locking cap further comprises a lower engaging member coupled to the outer body, the lower engaging member being radially movable between an inward state and an outward state and configured to alternately engage and disengage at least one of a backside of the external flange and the connection point. Finally, the locking cap has an upper engaging member coupled to the outer body and being radially movable independently of the lower engaging member between an inward state and an outward state and configured to engage and disengage the inner body, and at least one of the upper engaging member and the inner body having a ramp surface to exert a preload force on a seal disposed between the cap and the subsea member as the upper engaging member is moved inwardly toward the inward state. The method continues by lowering the cap toward the subsea member and inserting an end of the subsea member into the cavity, and then energizing the lower engaging member to engage at least one of a backside of the external flange and a Connection point. The method concludes by energizing the upper engaging member to engage the inner body exerting a preload force on the seal.

An advantage of a preferred embodiment of the present invention is that the apparatus caps a subsea member having an external flange; thus, preventing the flow of fluids and gases such as oil and methane into the surrounding environment. Furthermore, the present invention accomplishes this task without risk of clogs formed by methane hydrate crystals. In addition, the present invention overcomes problems with excessive reservoir pressure at a wellhead by redirecting the fluid into a subsequently attached riser or a containment device.

BRIEF DESCRIPTION OF THE DRAWINGS

So that the manner in which the features, advantages, and objects of the invention, as well as others which will become apparent, are attained and can be understood in more detail, more particular description of the invention briefly summarized above may be had by reference to the embodiments thereof that are illustrated in the appended drawings that form a part of this specification. It is to be noted, however, that the drawings illustrate only certain preferred embodiments of the invention and are therefore not to be considered limiting of the invention's scope as the invention may admit to other equally effective embodiments.

DETAILED DESCRIPTION OF THE INVENTION

The present invention will now be described more fully hereinafter with reference to the accompanying drawings that illustrate embodiments of the invention. This invention may be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning drilling unit operation, materials, and the like have been omitted inasmuch as such details are not considered necessary to obtain a complete understanding of the present invention, and are considered to be within the skills of persons skilled in the relevant art.

Figure 1:
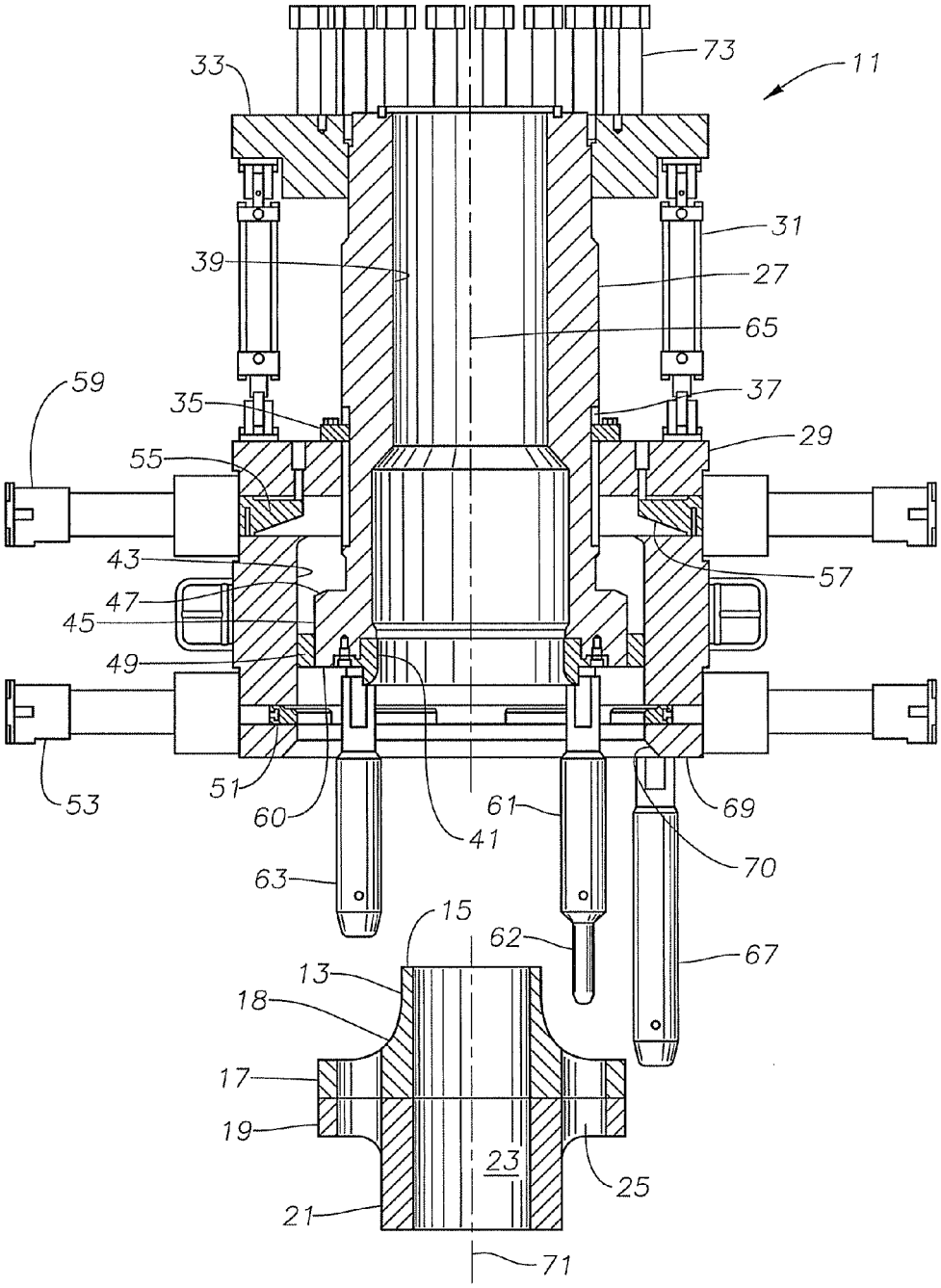
FIG. 1 is a vertical sectional view of a cap in accordance with this invention, shown being lowered onto a vertically-oriented made-up flange.

Referring to FIG. 1, cap assembly 11 is shown positioned over a made-up flange, which in this example comprises a lower riser connector 13. Lower riser connector 13 is a lower portion of a drilling riser (not shown) that normally, would extend to a floating vessel at surface. The riser has been damaged and severed from lower riser connector 13 by a cut 15 on the upper end of the lower riser connector 13. Lower riser connector 13 has a curved surface 18 that tapers in a downward direction to a riser flange 17 having a flat upper surface. Curved surface 18 is a curved frusto-conical surface.

In this example, lower riser connector 13 mounts on top of a blowout preventer 21 (BOP), the upper end of which is shown. BOP 21 has a BOP flange 19, and riser flange 17 bolts to BOP flange 19 by a series of bolts (not shown in FIG. 1). BOP 21 and lower riser connector 13 have a mating central passage 23 for drilling fluids and tools to pass through. The mating flanges 17 and 19 preferably have at least two holes 25 that do not contain bolts. The bolts from holes 25 may have been removed, or holes 25 may have originally been left open for another purpose, such as allowing fluid lines to pass through. In this example, holes 25 are spaced 180 degrees apart from each other, but other circumferential spacings between holes 25 may be employed. A person skilled in the art will understand that lower riser connector 13 and BOP 21 could alternatively be another type of connection point.

Cap assembly 11 includes an inner body 27 and an outer body 29, both being cylindrical, tubular members. A plurality of lifting devices, such as hydraulic cylinders 31, extend between outer body 29 and a bracket 33 attached to an upper end of inner body 27. When energized, hydraulic cylinders 31 will stroke inner body 27 and outer body 29 relative to each other from a contracted position to an extended position. Outer body 29 is in its upper position relative to inner body 27 in FIG. 1. A person skilled in the art will understand that other devices and methods, such as remotely operated screw lifts, for moving inner body 27 and outer body 29 relative each other are contemplated and included in this invention. Likewise, methods that do not require motion between inner body 27 and outer body 29 may be used, for example, inner body 27 and outer body 29 may comprise a single unit.

Inner body 27 has a lower portion that locates within a cavity 43 of outer body 29. The lower portion of inner body 27 includes a flange 45 that extends radially outward from the exterior of inner body 27. Flange 45 has an upward facing shoulder 47. Upward facing shoulder 47 may be beveled as illustrated in FIG. 1 or, alternatively, a horizontal surface. A bushing or guide member 49 may be mounted to the outer diameter of flange 45 for sliding along the inner diameter of cavity 43. In the example shown, the lower rim of inner body 27 is still recessed within outer body 29 when outer body 29 is in its upper position. A stop member 35 mounted on the upper end of outer body 29 serves to limit the axial movement of inner and outer bodies 27, 29 between the extended and retracted positions. Stop member 35 may be a portion of a ring that engages a recess 37 formed in the exterior of inner body 27, or it may be other devices.

Inner body 27 has a bore 39 with a seal 41 mounted at the lower end. Seal 41 has a curved lower portion for sealing against curved portion 18 of lower riser connector 13. Seal 41 may be a variety of configurations and materials. FIGS. 2A-2D show four embodiments for seal 41. Each embodiment includes a metal body 32, such as of steel, defining one or more recesses 42, a flange 34 for securing to inner body 27, and one or more inner body seal members 44 for sealing seal 41 against inner body 27. A person skilled in the art will understand that alternative embodiments contemplate and include seal 41 without recesses 42 and inner body seal members 44. Likewise, a person skilled in the art will understand that alternative embodiments contemplate and include use of elastomerics, soft metals, and the like, to construct inner body seal members 44. Inner body seal members 44 may also comprise taper sealing surfaces, flat sealing surfaces, or the like rather than curved sealing surfaces.

Figure 2A:
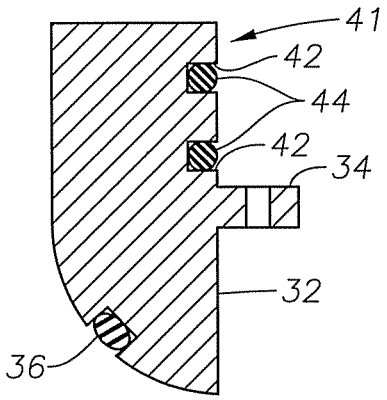
FIGS. 2A-2E are sectional views of alternate embodiments of a seal of the cap of FIG. 1.
Figure 2B:
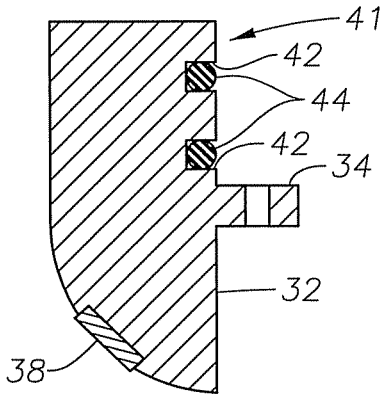
Figure 2C:
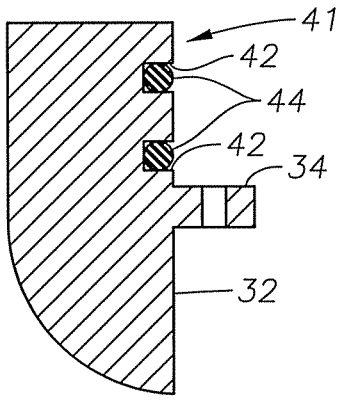
Figure 2D:
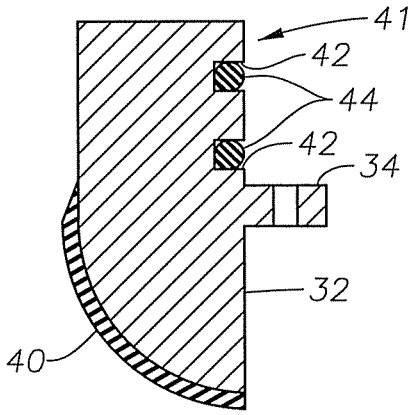

In FIG. 2A, an elastomeric seal member 36, formed of a material such as rubber, is located in a groove in the lower portion of body 32 for sealing against curved surface 18. In FIG. 2B, seal 41 has an inlay 38 of a soft metal on the lower portion for metal-to-metal sealing. In FIG. 2C, the entire lower portion is of the same steel material as body 32 for forming a metal-to-metal seal. In FIG. 2D, seal 41 has an elastomeric layer 40 bonded to its lower portion for forming a seal. Other variations may include an inflatable seal 41.

Preferably, flange 34 loosely couples to inner body 27. As illustrated in FIG. 2A, elastomeric seal member 36 defines an annular member having a different diameter than that of the curved lower portion of seal 41. Similarly, inner body seal members 44 define annular members having a different diameter than that of the vertical portion of seal 41. Following placement and engagement of cap assembly 11, described in more detail below, differential pressures caused by the passage of fluids through mating central passage 23 into bore 39 causes movement of cap assembly 11. As cap assembly 11 moves, loosely coupled seal 41 will float relative to cap assembly 11. The float of seal 41 allows the differential diameters of elastomeric seal member 36 and inner body seal members 44 to maintain contact with and further seal inner body 27 and curved surface 18 of lower riser connector 13. In this manner, the pressures within bore 39 further set seal 41, increasing the strength of the seal during operational use of cap assembly 11. Similarly, the differential diameters created by inlay 38 of FIG. 2B, the inner body seal members 44 of FIG. 2C, and elastomeric layer 40 of FIG. 2D will maintain contact with inner body 27 as bore 39 is pressurized following placement and engagement of cap assembly 11.

Figure 2E:
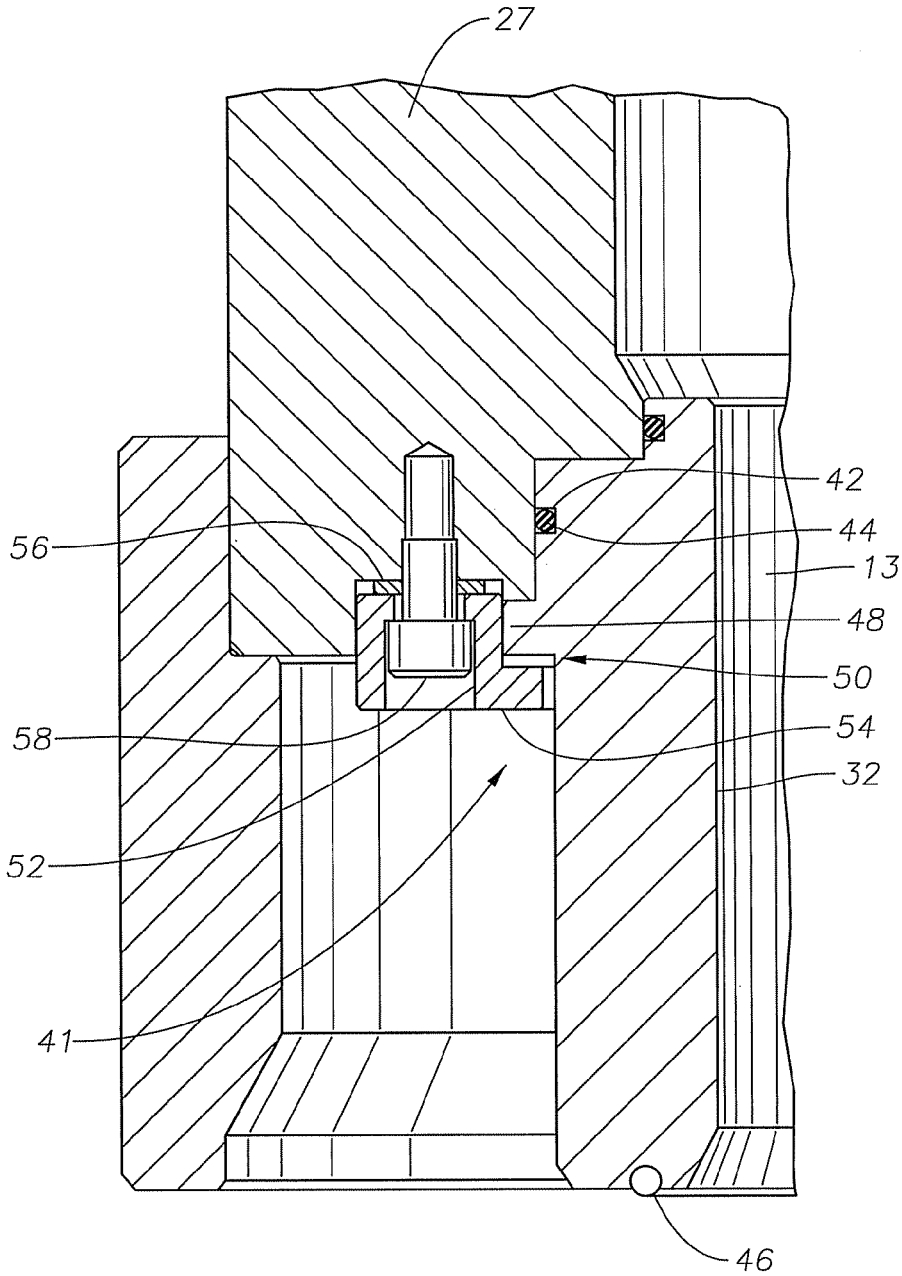

Referring now to FIG. 2E, there is shown an alternative embodiment of seal 41 for capping lower riser connector 13 that does not have riser flange 17. In the illustrated embodiment, seal 41 has a metal body 32, such as of steel, and a retainer ring 52. Metal body 32 has an inner diameter capable of fitting flush against lower riser connector 13. Metal body 32 also defines one or more recesses 42, an outer flange 48, and one or more inner body seal members 44 for sealing seal 41 against inner body 27. A person skilled in the art will understand that alternative embodiments contemplate and include seal 41 without recesses 42 and inner body seal members 44. Likewise, a person skilled in the art will understand, that alternative embodiments contemplate and include use of elastomerics, soft metals, and the like, to construct inner body seal members 44. Inner body seal members 44 may also comprise taper sealing surfaces, flat sealing surfaces, or the like rather than curved sealing surfaces. An elastomeric seal member 46, formed of a material such as rubber, is located in a groove in the lower portion of body 32 for sealing against a horizontal surface of lower riser connector 13 or an upper surface of BOP flange 19.

Seal retainer ring 52 comprises a U-shaped ring defining an inner flange 54 near a lower end of seal retainer ring 52 proximate to metal body 32. Seal retainer ring 52 couples to a lower rim of inner body 27 by bolt 58. Interposed between seal retainer ring 52 and the lower rim of inner body 27 is a spacing washer 56 of a thickness such that a gap 50 will exist between inner flange 54 and outer flange 48. Preferably, gap 50 allows seal 41 of FIG. 2E to float similar to seal 41 of FIGS. 2A-2D. Elastomeric seal member 46 defines an annular member having a different diameter than that of a surrounding lower portion of metal body 32. Similarly, inner body seal members 44 define annular members having a different diameter than that of the surrounding vertical portions of metal body 32. Following placement and engagement of cap assembly 11, described in more detail below, differential pressures caused by the passage of fluids through mating central passage 23 into bore 39 causes movement of cap assembly 11. As cap assembly 11 moves, gap 50 will allow seal 41 to float relative to cap assembly 11. The float of seal 41 allows the differential diameters of elastomeric seal member 46 and inner body seal members 44 to maintain contact with and further seal inner body 27 and lower riser connector 13. As described above, the pressures within bore 39 further set seal 41, increasing the strength of the seal during operational use of cap assembly 11. In this manner, cap assembly 11 may seal to a subsea member having a bore without an attached flange.

Referring again to FIG. 1, outer body 29 has a lower engaging member that may be a plurality of lower dogs 51 or alternately segments of a ring, a collet, or some other device. In the illustrated embodiment, the lower engaging member has an engaged state configured to hold cap assembly 11 to BOP flange 19, and a disengaged state configured to not inhibit cap assembly 11 from movement onto and off of the lower riser connector 13 and BOP 21. Lower dogs 51 may be energized from the retracted position shown in FIG. 1 to an inward engaged position shown in FIGS. 10 and 11. In this example, lower dogs 51 are energized by a remote operated vehicle (ROV) that engages an ROV interface 53. The ROV may move lower dogs 51 inward by rotating a shaft or some other type of mechanism in ROV interface 53, such as supplying fluid pressure to a piston located within ROV interface 53. Alternately, lower dogs 51 could be spring-biased to the inward position. Furthermore, they could be controlled by hydraulic fluid pressure delivered from a surface vessel to cap assembly 11 via an umbilical or line (not shown).

Outer body 29 also has an upper engaging member that, in this example, comprises a set of upper dogs 55 located above lower dogs 51. In the illustrated embodiment, the upper engaging member is configured to alternately apply a load to or remove a load from inner body 27. Upper dogs 55 may alternately be segments of a ring, a collet, or some other device. Upper dogs 55 are located at the upper end of cavity 43 and will move from the retracted position shown in FIG. 1 to the inward engaging position shown in FIG. 11. Upper dogs 55 may be moved inward by an ROV engaging an ROV interface 59. ROV interface 59 may comprise a device that moves upper dogs 55 inward by rotating a screw mechanism. Alternately, the ROV could move upper dogs 55 inward by supplying hydraulic fluid to move them inward. In another embodiment, upper dogs 55 could be energized by a hydraulic fluid supply from a surface vessel. In yet another embodiment, upper dogs 55 could be spring-biased to the inward position.

A long guide pin 61 extends downward from a lower edge or rim 60 of inner body 27. Long guide pin 61 is a cylindrical member in this embodiment that may have a lower entry portion 62 of smaller diameter. Long guide pin 61 has its upper end fixed to inner body 27, such as by threads. Long guide pin 61 extends below outer body 29 even when outer body 29 is in its lower position.

A short guide pin 63 also secures to lower rim 60 of inner body 27. Short guide pin 63 is also a cylindrical member. It optionally may have a slightly larger diameter than long guide pin 61. Short guide pin 63 has a shorter length than long guide pin 63, but also protrudes below outer body 29 when outer body 29 is in the lower position. Short guide pin 63 may have a tapered nose. Short guide pin 63 is spaced for engaging one of the holes 25 in flange 17 after long guide pin 61 has engaged the other of the empty holes 25. In this example, the empty holes 25 are spaced 180° apart, thus guide pins 61 and 63 are 180° apart from each other relative to a longitudinal axis 65 of cap assembly 11. Guide pins 61 and 63 are parallel to a longitudinal axis 65 of cap assembly 11. A person skilled in the art will understand that alternative embodiments may not include guide pins 61 and 63.

A stop pin 67 is mounted to a lower edge or rim 69 of outer body 29. Stop pin 67 extends downward parallel to axis 65. Stop pin 67 is spaced farther from axis 65 than guide pins 61, 63 so that when guide pins 61, 63 are in flange holes 25, the side surface of stop pin 67 will be touching an outer diameter portion of flanges 17, 19. Stop pin 67 may have a length that is approximately the same as long guide pin 61 or it may differ. Stop pin 67 may be spaced circumferentially from both guide pins 61, 63, as in this example. A person skilled in the art will understand that alternative embodiments may not include stop pin 67.

An annular tapered surface or bevel 70 extends upward from an inner edge of rim 70 of outer body 29 and joins the cylindrical wall defining cavity 43. Stop pin 67 secures to a threaded hole in rim 69 radially outward from bevel 70.

Bracket 33 has a series of bolts 73 that extend upward for connecting cap assembly 11 to additional equipment. That equipment may include a valve block containing valves or a lower end of another riser. Further, the additional equipment may comprise a running tool for lowering cap assembly 11 on drill pipe or on a lift line.

In FIG. 1, axis 71 of riser connector 11 is oriented vertical. However, it may be tilted as shown FIGS. 7-8, which illustrate a tilt of approximately 4.6° from vertical. The tilting may be a result of damage to BOP 21 or to a subsea wellhead housing onto which BOP 21 is connected. Also, curved surface 18 of lower riser connector 13 leading from flange 17 to cut 15 may be generally symmetrical or it may be asymmetrical about axis 71. Damage may have occurred, causing the portion at cut 15 to be asymmetrical about axis 71. The center point at cut 15 may be offset laterally in one direction from axis 71. If the portion at cut 15 is symmetrical about axis 71, cap assembly 11 may be lowered onto lower riser connector 13 with its axis 65 generally aligned with riser connector axis 71. Preferably, whether or not the upper portion of riser connector 13 is symmetrical or asymmetrical, cap assembly 11 is oriented with its axis 65 vertical while being lowered onto riser connector 13. If lower riser connector axis 71 is vertical, cap axis 65 and riser connector axis 71 would coincide with each other while cap assembly 11 is only a short distance above riser connector 13. Even if lower riser connector axis 71 is tilted slightly, if cut 15 is generally symmetrical about axis 71, it may be possible to lower cap assembly 11 with its axis 65 generally centered on riser connector axis 71.

Figure 3:
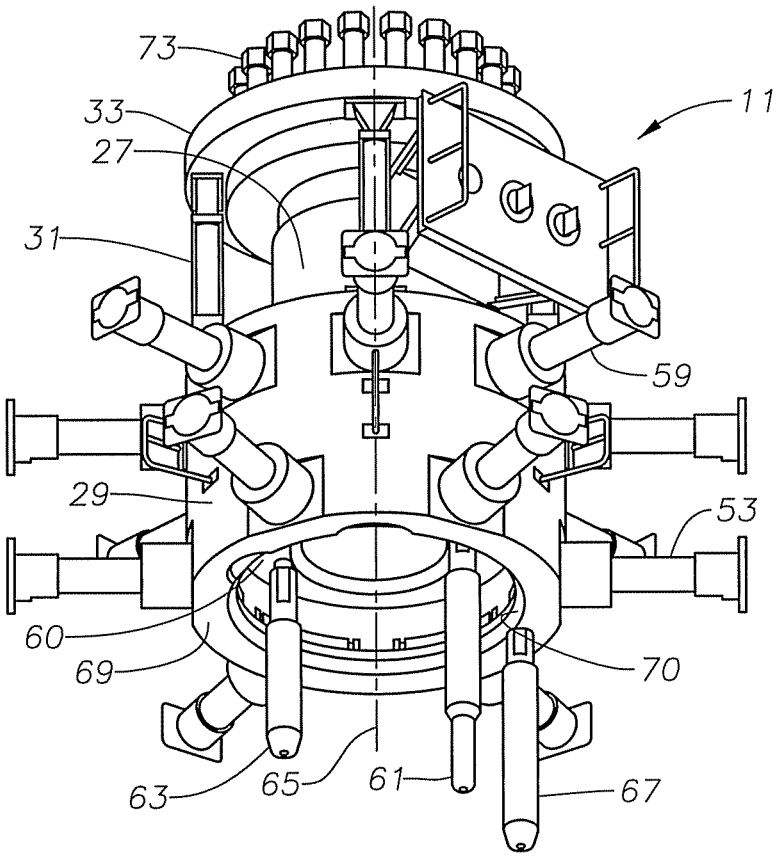
FIG. 3 is a perspective view illustrating the cap of FIG. 1.
Figure 5:
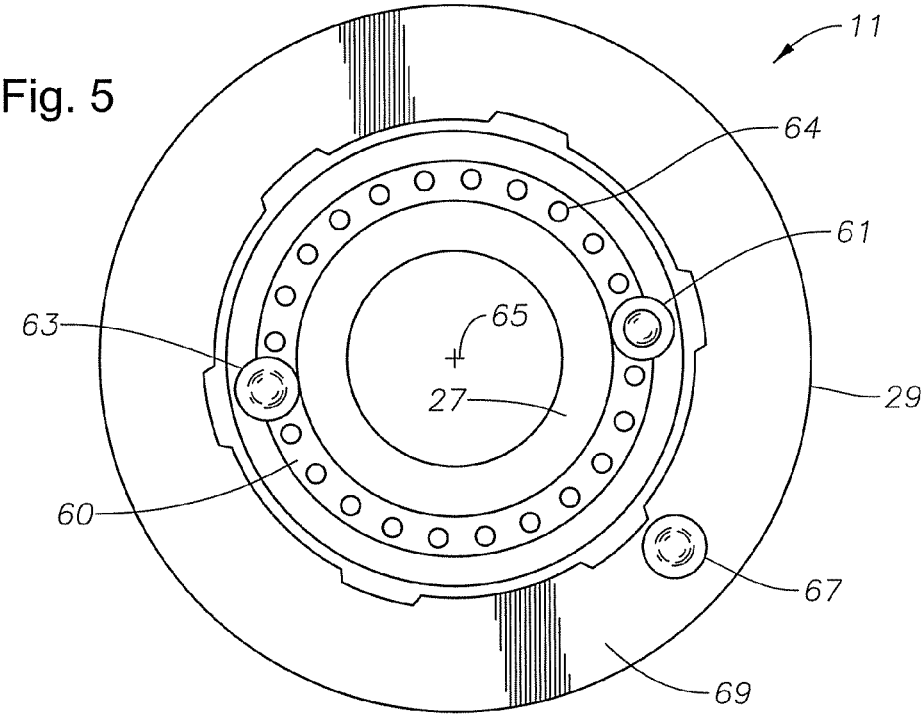
FIG. 5 is a bottom view of the cap as shown in FIG. 3.

For a riser connector 13 with a symmetrical portion at cut 15 relative to axis 71, guide pins 61, 63 are spaced concentrically relative to axis 65, as shown in FIGS. 3 and 5. Referring to FIG. 5, the radius from guide pin 61 to axis 65 is the same as the radius from guide pin 63 to axis 65. Stop pin 67 serves as a guide in the embodiment of FIGS. 3 and 5 by contacting the outer diameter of flanges 17, 19. Stop pin 67 is shown in FIG. 5 about 30 degrees from long guide pin 61 and 150 degrees from short guide pin 63, but other angles are possible. Preferably, guide pins 61, 63 are substantially aligned with their respective holes 25 before lowering guide pins 61, 63 into their respective holes 25. Long guide pin 61 first enters one of the holes 25, then continued lowering causes short guide pin 63 to enter its hole 25. Some rotation of cap assembly 11 may be required for this alignment to occur.

Figure 4:
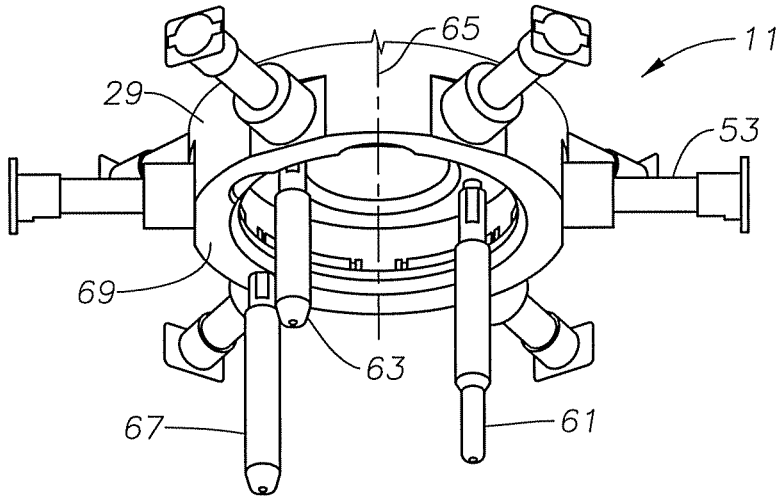
FIG. 4 is perspective view of a lower portion of the cap as shown in FIG. 3, but illustrating the guide pins and stop pin re-positioned for installation on a made-up flange that has an upper asymmetrical portion.
Figure 6:
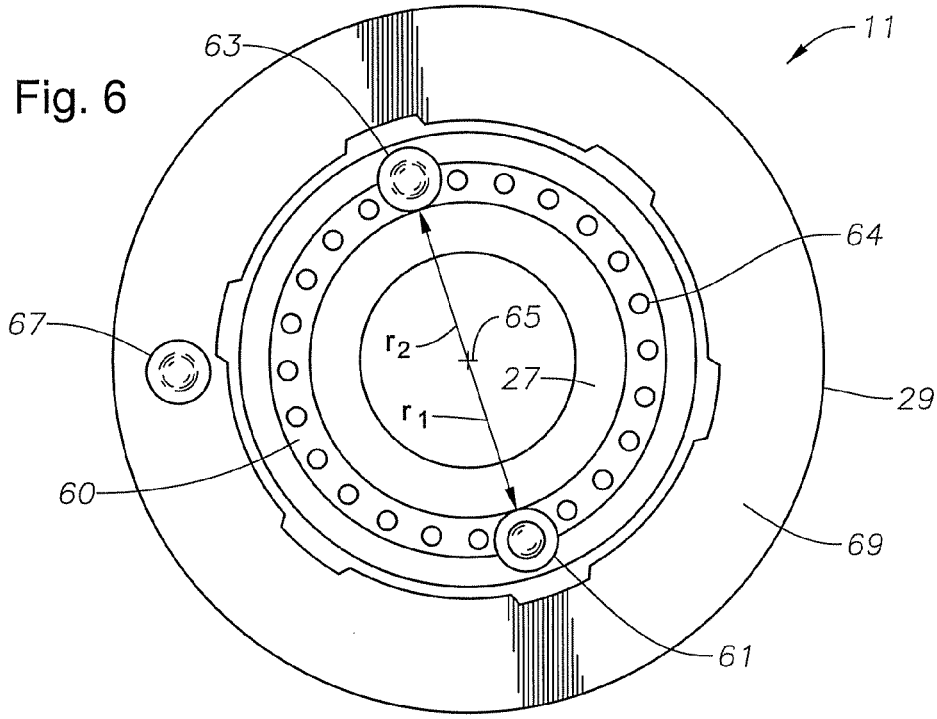
FIG. 6 is a bottom view of the cap as shown in FIG. 4.

If the portion of riser connector 13 adjacent cut 15 is asymmetrical, it may not be possible for guide pins 61, 63 to be aligned then lowered straight into holes 25. FIGS. 4 and 6 show an arrangement of guide pins 61, 63 and stop pin 67 that may be employed if riser connector 13 is asymmetrical relative to flange axis 71. Preferably, inner body 27 has a plurality of threaded holes 64 on its rim 60 for securing guide pins 61, 63. Some individual threaded holes 64 are at different radial distances from axis 65 than others. In FIG. 6, guide pins 61, 63 have been secured to different threaded holes 64 in rim 60 from FIG. 5, so that a point equidistant between guide pins 61, 63 will not coincide with cap assembly axis 65. Rather, a center point between guide pins 61, 63 will be slightly offset from axis 65. Long guide pin 61 is at a greater distance r1 to axis 65 than distance r2 of short guide pin 63 to axis 65. The distance r1 plus r2 between guide pins 61, 63 is still the same distance as between holes 25 (FIG. 1). The distance r2 is less than the distance from short pin 63 to axis 65 in FIG. 5. The distance r1 is greater than the distance from long pin 61 to axis 65 in FIG. 5. Stop pin 67 is about 70 degrees from short pin 63 and 110 degrees from long pin 61 in this example, but these angles could differ.

Figure 7:
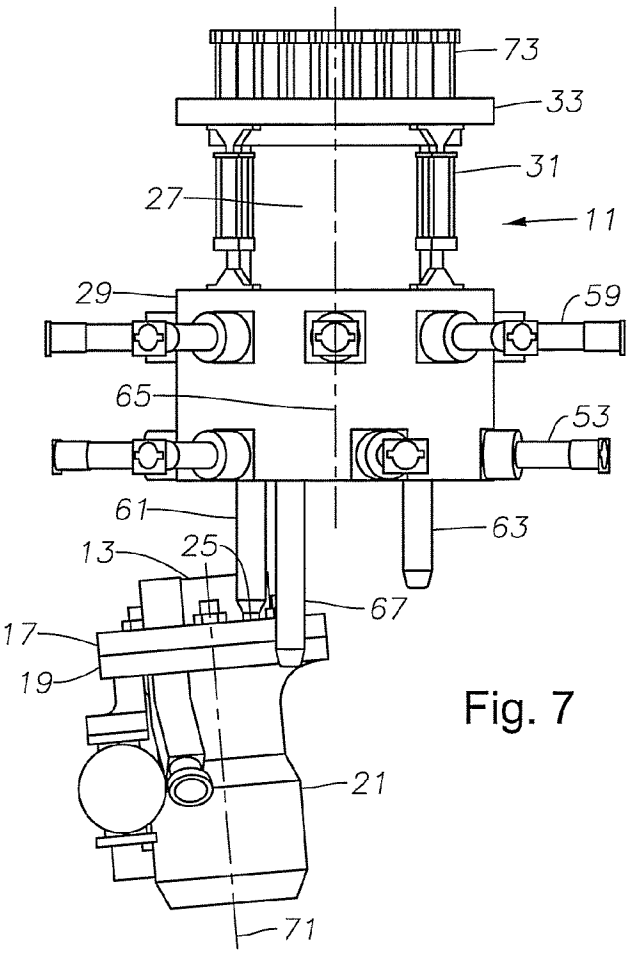
FIG. 7 is a perspective view of the cap configured as in FIG. 6, shown during a first step in engaging a made-up flange, which involves lowering a long guide pin through one of the holes in the made-up flange.

FIG. 7 illustrates a first step in installing cap assembly 11 on a tilted lower riser connector 13 with an asymmetrical upper portion. Cap assembly 11 has its axis 65 oriented vertically while being lowered subsea. Outer body 29 will be in its upper position relative to inner body 27, with guide pins 61, 63 protruding below the lower end of outer body 29. Long guide pin 61 is first stabbed a short distance into one of the holes 25. When this occurs, cap assembly 11 will be oriented so that its axis 65 is spaced laterally or outboard from flanges 17, 19. Short guide pin 63 will also be laterally spaced or outboard from flanges 17, 19, far out of alignment with its respective hole 25. Long guide pin 61 will only enter an upper portion of its hole 25 so that the lower end of short guide pin 63 is at a higher elevation than the upper flat surface of riser flange 17. The lower end of short guide pin 63 need not be at an elevation higher than severed upper end 15 (FIG. 1) because it will swing around the asymmetrical portion of lower riser connector 13 during the next step. Preferably, an ROV with a video camera will be in assistance. A paint mark (not shown) on long guide pin 61 will indicate to the ROV operator in a surface vessel when the proper amount of penetration in hole 25 has occurred.

Figure 8:
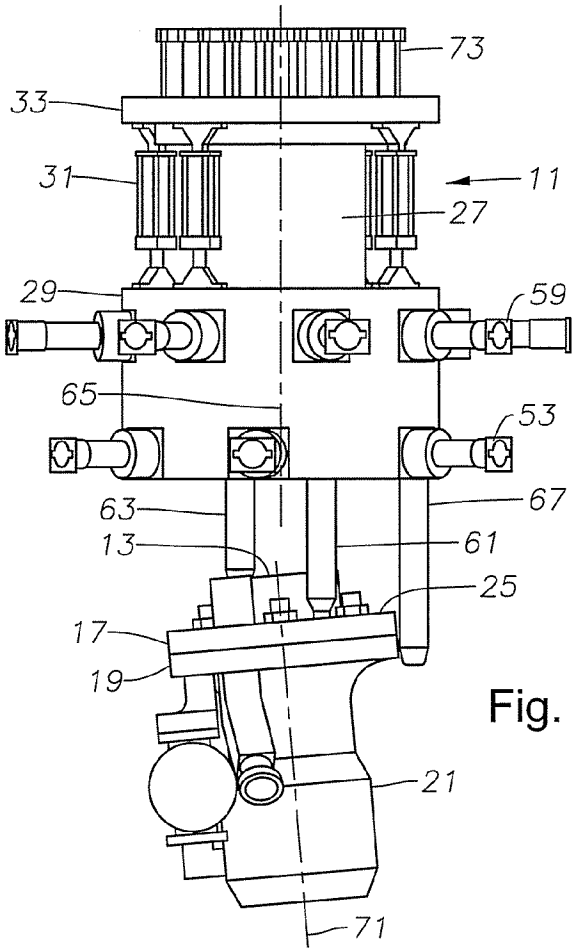
FIG. 8 is a perspective view similar to FIG. 7, illustrating a second step, which involves rotating the cap.

Referring to FIG. 8, the operator then rotates cap assembly 11 about long guide pin 61. In this example, the rotation is counterclockwise while looking down on cap assembly 11. The rotation will be around the hole 25 receiving long guide pin 61, not around cap assembly axis 65. The degree of rotation is the amount that is required to swing stop pin 67 around until it bumps against the outer diameter of flanges 17 and 19. The amount of rotation will be less than 360 degrees and will depend on the position of stop pin 67 when long guide pin 61 enters hole 25. Stop pin 67 is positioned relative to guide pins 61, 63 so that when stop pin 67 bumps against the outer diameter of flanges 17, 19, short guide pin 63 will be aligned above the other hole 25 (not shown). FIG. 8 illustrates stop pin 67 bumping against flanges 17, 19, and short guide pin 63 aligned with the other of the holes 25. The offset positions of guide pins 61, 63 relative to axis 65 will position cap axis 65 offset from lower riser connector axis 71 at this point.

Figure 9:
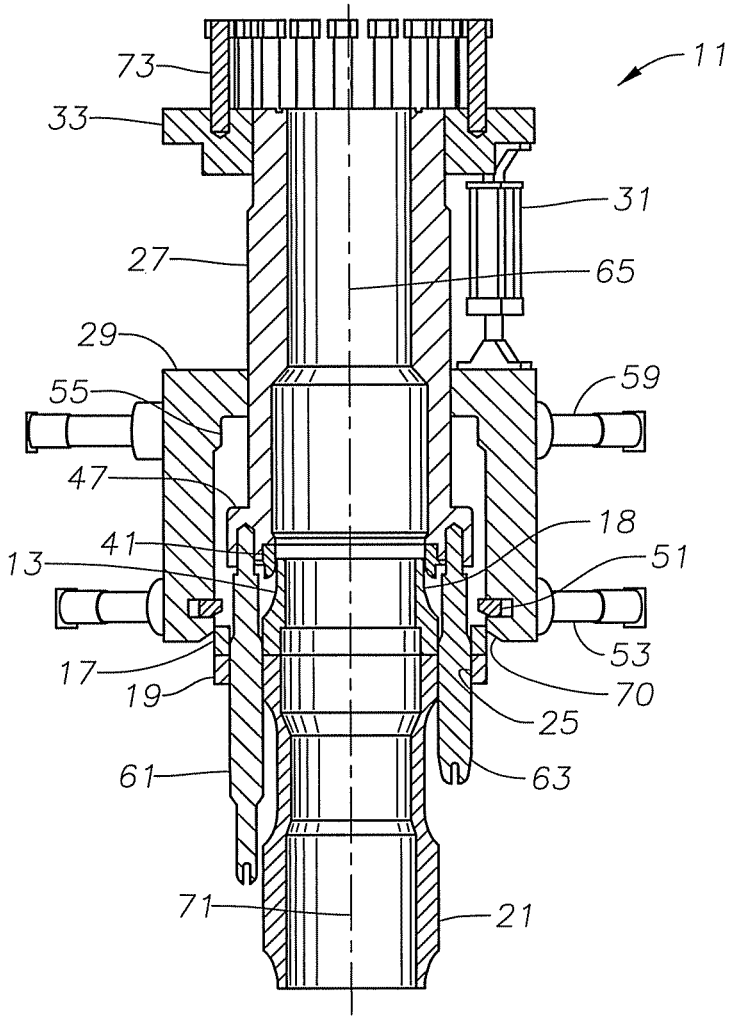
FIG. 9 is a sectional view of the cap and made-up flange of FIG. 7, illustrating a third step, which involves lowering both guide pins through holes in the made-up flange.

The operator then lowers cap assembly 11, which causes guide pins 61, 63 to move downward in their respective holes 25. Lowering cap assembly 11 also causes axis 65 of cap assembly 11 to tilt and align with the tilted inclination of lower riser connector 13. As cap assembly 11 moves downward, the offset in axis 65 relative to axis 71 allows seal 41 (FIG. 1) to clear the laterally protruding upper portion of lower riser connector 13. FIG. 9 shows seal 41 in close proximity, but not yet landed on lower riser connector 13. Bevel 70 on lower rim 69 of outer body 29 will be engaging riser flange 17 before seal 41 touches riser connector 13 (not shown in FIG. 9). Outer body 29 will still be in the upper position relative to inner body 27. The inner diameter of outer body 29 at bevel 70 is only slightly larger in diameter than riser flange 17, thus bevel 70 will cause cap assembly 11 to move slightly laterally from the offset position to an aligned position wherein axis 65 coincides with axis 71. Guide pins 61, 63 are slightly smaller than their respective guide holes 25 to allow this lateral shifting to occur. Once axes 65, 71 are aligned, seal 41 will land on curved surface 18. Another paint line (not shown) on long guide pin 61 will indicate when seal 41 has properly landed on curved surface 18. When seal 41 has properly landed, each guide pin 61, 63 will be slightly offset in its respective flange hole 25.

Figure 10:
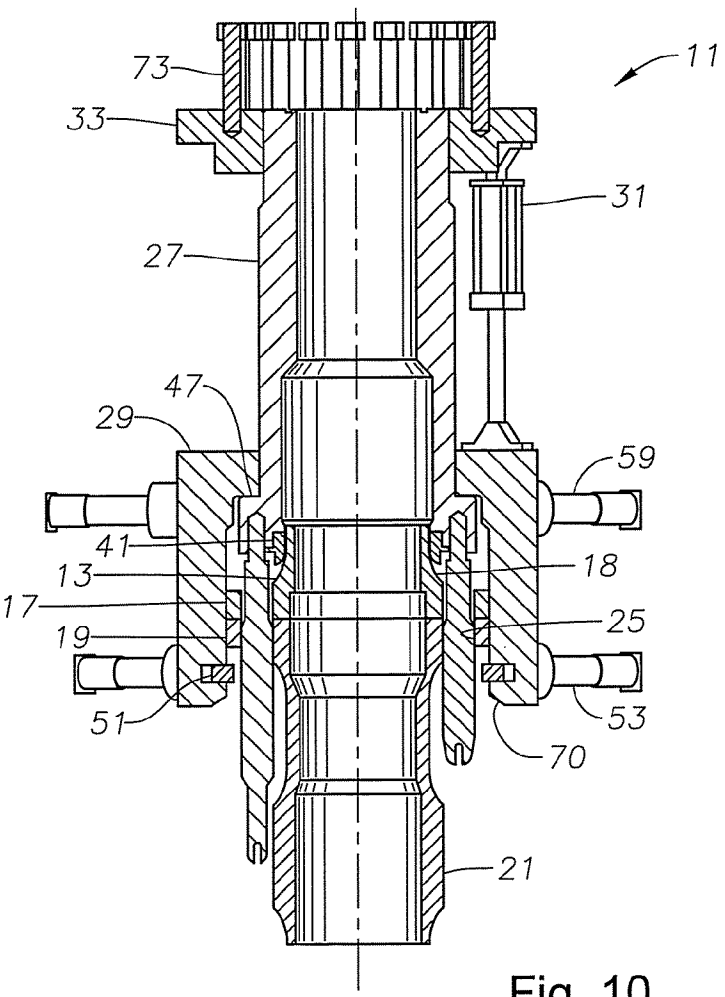
FIG. 10 is a sectional view similar to FIG. 9, illustrating a fourth step, which involves stroking the outer body of the cap downward relative to the inner body and stroking the lower dogs.

Referring to FIG. 10, the operator then applies fluid pressure to hydraulic cylinders 31 to stroke outer body 29 downward relative to inner body 27, which is now aligned and resting on lower riser connector 13. While outer body 29 is in its lowest position relative to inner body 27, lower dogs 51 will be located at a lower elevation than the lower side of BOP flange 19. The operator then strokes lower dogs 51 inward by engaging ROV interfaces 53. Preferably, lower dogs 51 will be spaced a short distance below the lower side of BOP flange 19 once in the inward positions.

Figure 11:
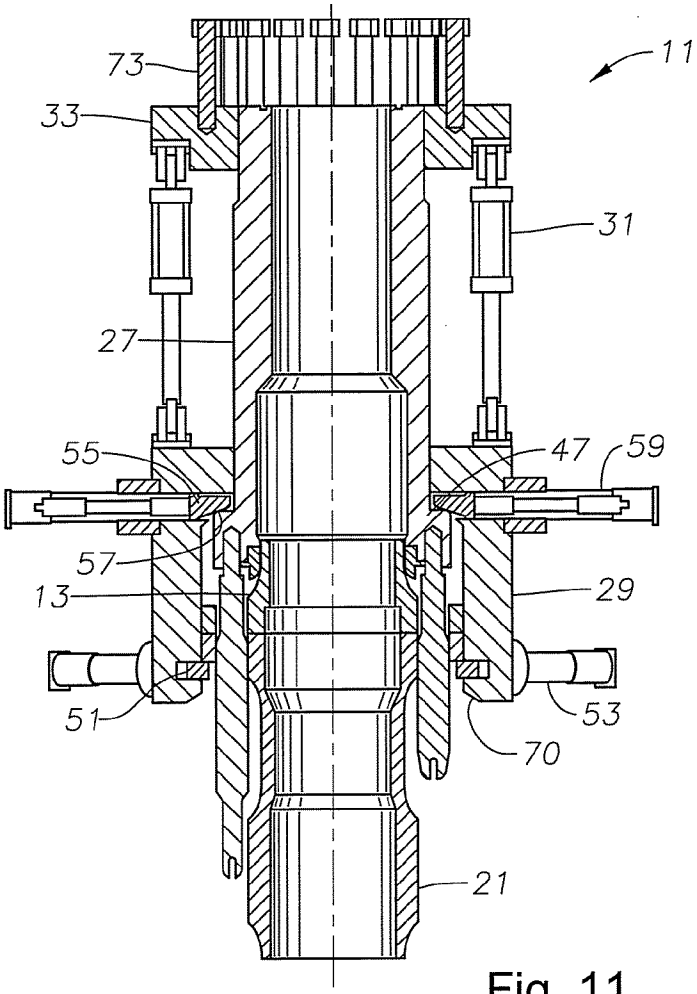
FIG. 11 is a sectional view similar to FIG. 10, illustrating a fifth step, which involves moving upper dogs inward.

Then, the operator will employ hydraulic cylinders 31 to lift outer body 29 relative to inner body 27 a short distance until lower dogs 51 abut the lower side of BOP flange 19. The operator will then stroke upper dogs 55 inward as shown in FIG. 11. The lower surfaces 57 of upper dogs 55 will engage upward facing shoulder 47, pushing downward on flange 45 and inner body 27 and pulling upward on outer body 29. The engagement of upper dogs 55 with upward facing shoulder 47 causes a preload force to occur that lower dogs 51 react to by engaging the lower sides of BOP flange 19. The application of the preload force forms a tight seal between seal 41 and curved surface 18. Guide pins 61, 63 aren't shown in FIGS. 10 and 11, but will remain in their respective holes 25. If needed, a sealant can be injected through a port (not shown) in cap assembly 11 between curved surface 18 and the area around seal 41. Any fluid flowing up through lower riser connector 13 will thus flow into inner body bore 39 where it may be delivered to the surface or otherwise contained.

It may be possible to disconnect lower riser flange 17 from BOP flange 19 before running cap assembly 11. If so, cap assembly 11 could land on and connect to BOP flange 19 employing lower dogs 51 and upper dogs 55. Seal 41 could be reconfigured to seal on the inner diameter of BOP 21 just below BOP flange 19 or on the face of BOP flange 19. The concentric arrangement of guide pins 61, 63 shown in FIG. 5 could be employed.

While described in connection with a blowout preventer and lower riser connector, the invention is also applicable to connecting to other types of made-up flanges or connection points.

By the use of the present invention, a made-up flange may be capped; thus, preventing the flow of fluids and gases such as oil and methane into the surrounding environment. Furthermore, the present invention accomplishes this task without risk of clogs formed by methane hydrate crystals. In addition, the present invention overcomes problems with excessive reservoir pressure by redirecting the fluid into a subsequently attached riser or a containment device.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

The invention claimed is:

1. An apparatus for connecting to a subsea member having an external flange or a connection point, the apparatus comprising:

a tubular outer body defining a cavity;

a tubular inner body defining a bore, wherein the lower end of the inner body resides within the cavity;

a lower engaging member coupled to the outer body and configured to engage at least one of a backside of the external flange and a connection point, the lower engaging member being configured to move radially between a radially advanced position engaging at least one of the backside of the external flange and the connection point and a radially withdrawn position disengaged from at least one of the backside of the external flange and the connection point; and an upper engaging member coupled to the outer body and configured to engage the inner body, the upper engaging member being configured to move radially independently of the lower engaging member between a radially advanced position engaging the inner body and a radially withdraw position disengaged from the inner body;

wherein the upper engaging member has a downward-facing ramp surface configured to slidingly engage a flange of the inner body as the upper engaging member moves radially inward to the advanced position to exert a preload force on a seal disposed between the apparatus and the subsea member.

2. The apparatus of claim 1, further comprising a lifting device secured between the outer body and the inner body and configured to stroke the inner body and the outer body relative to one another from a contracted position to an extended position.

3. The apparatus of claim 1, wherein the apparatus further comprises at least one guide pin coupled to a lower rim of the inner body and extending parallel to a longitudinal cavity axis beyond a lower end of the outer body.

4. The apparatus of claim 1, wherein the apparatus further comprises a stop pin coupled to a lower rim of the outer body and extending parallel to a longitudinal cavity axis beyond a lower end of the outer body.

5. The apparatus of claim 1, wherein the outer body comprises a bevel extending from a lower rim of the outer body to an interior wall of the outer body, the interior wall defining a lower edge of the cavity.

6. The apparatus of claim 1, wherein the inner body comprises: a bracket coupled to an upper end of the exterior of the inner body; and the seal coupled to a lower end of the interior wall of the inner body, the interior wall defining the bore.

7. The apparatus of claim 6, wherein the seal comprises: a metal body having a curved lower portion; and a flange that secures the seal to the inner body.

8. The apparatus of claim 7, wherein: the curved lower portion of the seal defines a seal member recess extending from an edge of the curved lower portion radially inward; and an elastomeric member substantially fills the seal member recess and is configured to create a seal against the subsea member having an external flange.

9. The apparatus of claim 7, wherein: the curved lower portion defines a seal member recess extending from an edge of the curved lower portion radially inward; and a soft metal member substantially fills the seal member recess and is configured to create a seal against the subsea member having an external flange.

10. The apparatus of claim 7, wherein the seal further comprises an elastomeric member bonded to an exterior of the curved lower portion and configured to create a seal against the subsea member having an external flange.

11. The apparatus of claim 1, wherein the lower end of the inner body remains within the cavity of the outer body in both the contracted position and the extended position.

12. The apparatus of claim 1, wherein the upper and the lower engaging members comprise dogs.

13. An apparatus for capping a subsea member having an external flange, the apparatus comprising:

a tubular outer body defining a cavity;

a tubular inner body having an upper end, a lower end disposed within the cavity, an outer surface extending between the upper end and the lower end, and a bore extending between the upper end and the lower end, wherein the outer surface comprises a flange at the lower end of the inner body;

a plurality of lower dogs coupled to the outer body and configured to engage a lower side of the external flange of the subsea member, the plurality of lower dogs being configured to move radially between a radially advanced position engaging the subsea member and a radially withdrawn position disengaged from the subsea member; and a plurality of upper dogs coupled to the outer body and configured to engage an upper side of the flange of the inner body, the plurality of lower dogs being configured to move radially independently of the upper dogs between a radially advanced position engaging the upper side of the flange of the inner body and a radially withdrawn position disengages from the upper side of the flange of the inner body; and wherein at least one of the plurality of upper dogs has a downward-facing ramp surface on a lower side configured to slidingly engage the upper side of the flange of the inner body as the upper dogs move radially inward to the advanced position to exert a preload force between the apparatus and the subsea member.

14. The apparatus of claim 13, wherein the apparatus further comprises:

a first guide pin coupled to a lower rim of the inner body and extending parallel to a longitudinal cavity axis beyond a lower end of the outer body; and a second guide pin coupled to the lower rim of the inner body and extending parallel to the cavity axis beyond a lower end of the outer body;

wherein the first guide pin has a first length and the second guide pin has a second length that is less than the first length.

15. The apparatus of claim 13, wherein the apparatus further comprises a stop pin coupled to a lower rim of the outer body and extending parallel to a longitudinal cavity axis beyond a lower end of the outer body.

16. The apparatus of claim 13, wherein the inner body comprises:

a bracket coupled to an upper end of an exterior of the inner body; and a seal coupled to a lower end of the interior wall of the inner body, the interior wall defining the bore, wherein the seal comprises a metal body having a curved lower portion, and a flange that secures the seal to the inner body.

17. The apparatus of claim 16, wherein: the curved lower portion of the seal defines a seal member recess extending from an edge of the curved lower portion radially inward; and an elastomeric member substantially fills the seal member recess and is configured to create a seal against the subsea member having an external flange.

18. The apparatus of claim 16, wherein: the curved lower portion defines a seal member recess extending from an edge of the curved lower portion radially inward; and a soft metal member substantially fills the seal member recess and is configured to create a seal against the subsea member having an external flange.

19. A method for connecting to a subsea member having an external flange or a connection point, the method comprising:

(a) providing a locking cap comprising:

a tubular outer body defining a cavity;

a tubular inner body defining a bore, wherein a lower end of the inner body resides within the cavity;

a lower engaging member coupled to the outer body, wherein the lower engaging member is configured to move radially between a radially advanced position and a radially withdrawn position; and an upper engaging member coupled to the outer body, wherein the upper engaging member is configured to move radially independently of the lower engaging member between a radially advanced position and a radially withdraw position;

(b) lowering the cap toward the subsea member and inserting an end of the subsea member into the cavity;

(c) moving the lower engaging member radially inward to the radially advanced position;

(d) lifting the outer body relative to the inner body after (c) to engage a backside of the external flange or the connection point with the lower engaging member;

(e) moving the upper engaging member radially inward to the radially advanced position after (d); and (f) slidingly engaging the inner body with a downward-facing ramp surface of the upper engaging member during (e) to exert a preload force on a seal positioned between the locking cap and the subsea member.

20. The method of claim 19, wherein the external flange or the connection point has two holes spaced circumferentially apart;

wherein (a) further comprises providing the cap with first and second guide pins coupled to the cap and extending downward, the guide pins being spaced apart circumferentially a same distance as the holes in at least one of the external flange and the connection point, the first guide pin being longer than the second guide pin; and a stop pin coupled to the cap and extending downward, the stop pin being spaced radially further from an axis of the cap than the guide pins; and wherein (b) further comprises:

lowering the cap toward the subsea member and inserting the first guide pin partially into one of the holes of the external flange;

rotating the cap about an axis of the first guide pin until the stop pin contacts a side of the external flange, which aligns the second guide pin with a second of the two holes in the external flange; and lowering the cap until the cap rests on the external flange.

* * * * *